US005782666A

United States Patent [19]

Bardi et al.

[11] Patent Number: 5,782,666

[45] Date of Patent: Jul. 21, 1998

[54] TELEVISION TUBE EXHAUST CART NOT EMPLOYING A WATER COOLING CIRCUIT

[76] Inventors: Gianluca Bardi, Via delle Panche No. 181, 50141 Firenze; Marco Panizza, Via Monte Oliveto No. 13, 50124 Firenze, both of Italy

[21] Appl. No.: 635,014

[22] Filed: Apr. 19, 1996

[30] Foreign Application Priority Data

Apr. 20, 1995 [IT] Italy ..... FI95 A 000074

[51] Int. Cl.[6] ..... H01J 9/385

[52] U.S. Cl. ..... 445/73; 445/54

[58] Field of Search ..... 445/70, 73, 39, 445/54

[56] References Cited

U.S. PATENT DOCUMENTS

| | | | |
|---|---|---|---|
| 3,115,732 | 12/1963 | Stewart | 445/73 |
| 3,796,475 | 3/1974 | Yamamoto et al. | 445/73 |
| 4,071,058 | 1/1978 | Albertin et al. | 141/65 |

FOREIGN PATENT DOCUMENTS

| | | |
|---|---|---|
| A-0667634 | 8/1995 | Germany . |
| A-2-082 835 | 3/1982 | United Kingdom . |

*Primary Examiner*—P. Austin Bradley
*Assistant Examiner*—Jeffrey T. Knapp
*Attorney, Agent, or Firm*—McGlew and Tuttle

[57] ABSTRACT

In a plant comprising a tunnel oven (2) and a plurality of carts moving around a closed circuit, each cart is equipped with a gripper (3) for gripping the stem of the television tube and with a set for forming the vacuum in the television tube; the gripper (3) is made up of a seat (13) and a gland (14A, 14B) for an O ring seal (11) to provide leaktightness around the stem. The ring seal (11) is protectively cooled by providing at least one block (331A, 431A) that conducts heat well when combined with one of the components (13 and/or 14) of the gripper (3). This block is able to transfer the heat from the gripper (3) out of the oven and give it up to a cold source such as a stream of air, through fins (331B, 431B) or the like. A protective shield (45) is also provided.

20 Claims, 3 Drawing Sheets

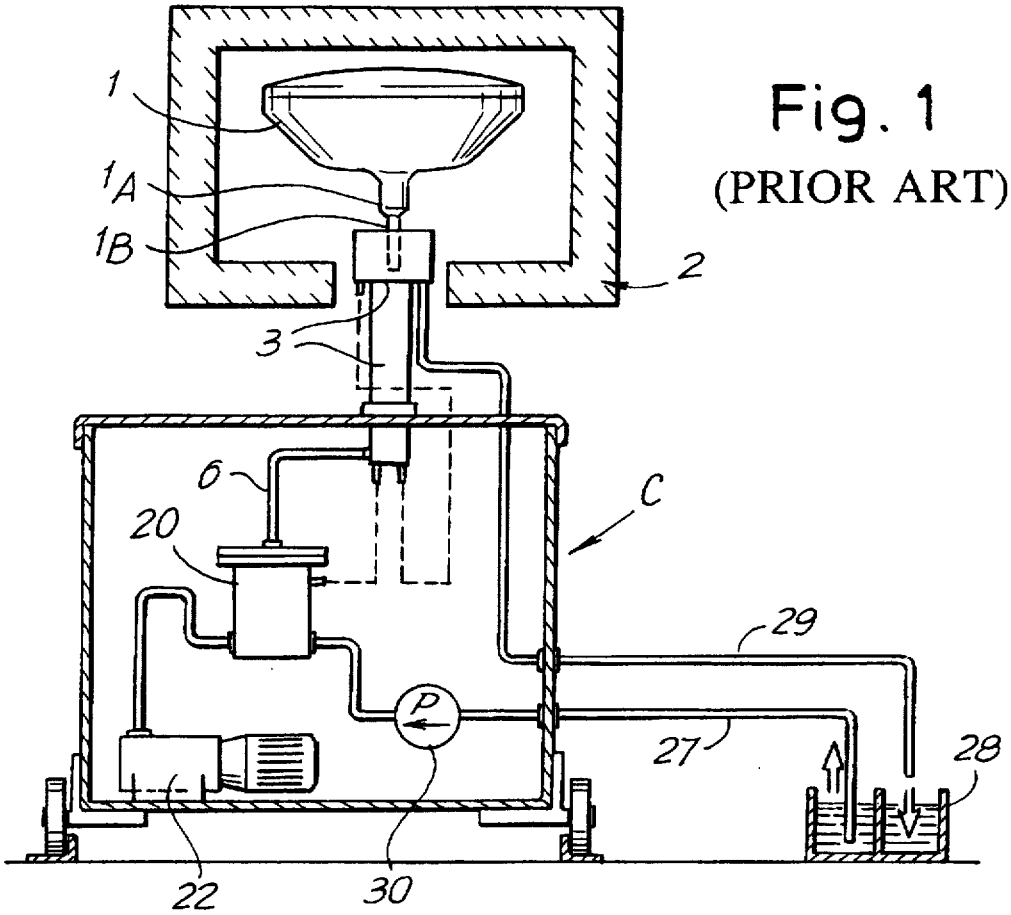
Fig. 1
(PRIOR ART)
(PRIOR ART)
Fig. 2
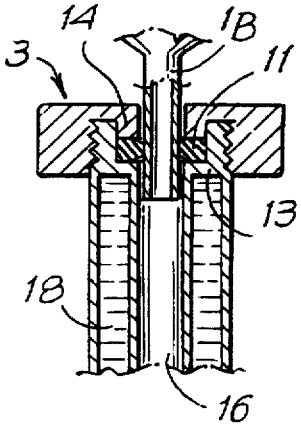
(PRIOR ART)
Fig. 3
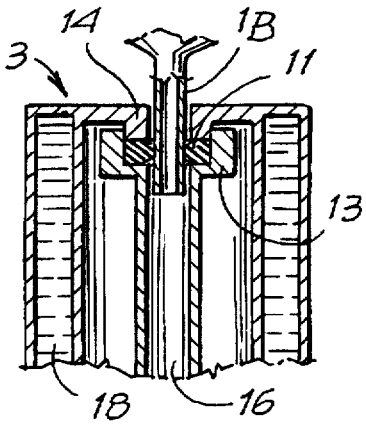
(PRIOR ART)
Fig. 4
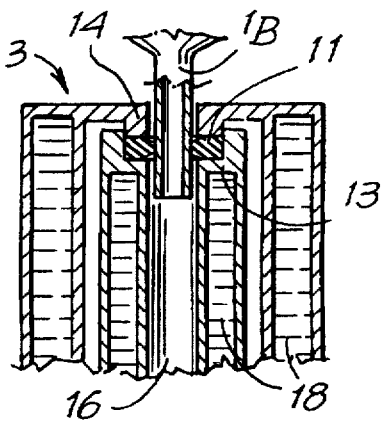

Fig. 5
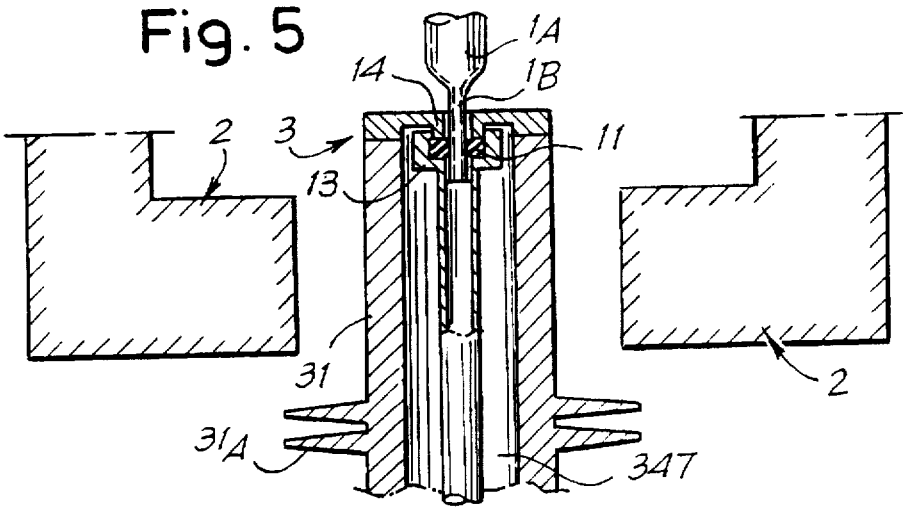
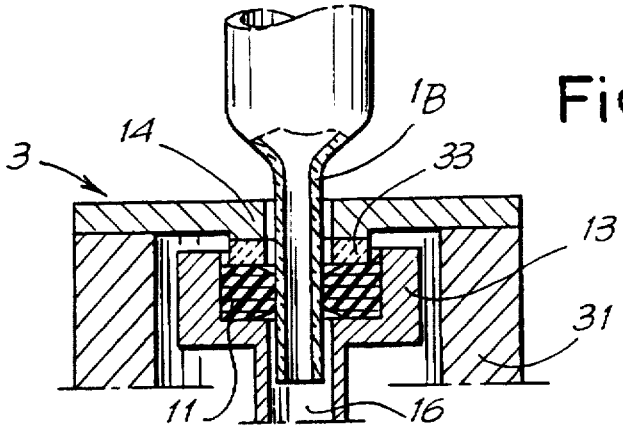
Fig. 6
Fig. 7
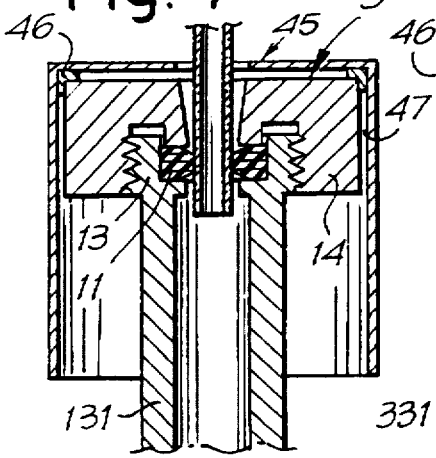
Fig. 8
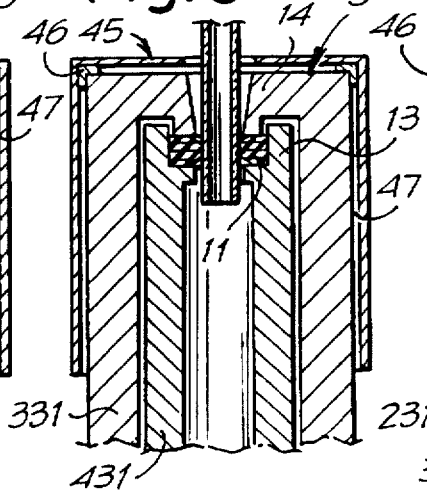
Fig. 9
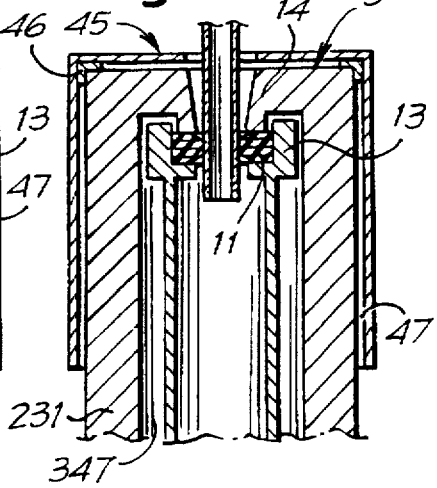

TELEVISION TUBE EXHAUST CART NOT EMPLOYING A WATER COOLING CIRCUIT

FIELD AND BACKGROUND OF THE INVENTION

A television tube is a cathode-ray tube used to produce images in television sets by converting an electrical signal into a luminous image. A vacuum must be formed inside it, and maintained over time, because otherwise the electrons would encounter molecules of gas in their path and be deflected from their trajectory and lose some of their kinetic energy, and the formation of positive ions would lead to the destruction of the electron gun. Evacuation is carried out in the final part of the television tube manufacturing process, in the so-called exhaust plant, which comprises: a) a series of carts, typically between 150 and 200, known as exhaust carts; b) a mechanical towing system that moves the carts through a corresponding number of stations, with intermittent or continuous motion; c) a tunnel oven called the exhaust oven, in whose interior the temperature rises from the ambient temperature, in the vicinity of the inlet, to a peak of 320°, 350° C., before falling again gradually to ambient temperature at the outlet. For a large part of the evacuation cycle, the top of the cart, on which the television tube is mounted, moves along inside the oven. The purpose of heating is to promote the release of the molecules of gas adhering to the internal walls of the television tube, so that they can be pumped away by the vacuum pumping system. Along the path of the oven, after the vacuum has been formed inside the television tube, the so-called tubular stem of the television tube is welded.

SUMMARY AND OBJECTS OF THE INVENTION

The object of the invention is to improve a plant for the exhaustion of television tubes and in particular to simplify the exhaust carts by dispensing with the conventional system of cooling the components by which the television tube is gripped by circulating water around them, leading to the problems shown in the following description.

The invention is defined in the claims which follow.

BRIEF DESCRIPTION OF THE DRAWINGS

The drawings illustrate the state of the art and examples of embodiments of the invention.

FIG. 1 is a diagram of a conventional exhaust cart;

FIGS. 2, 3 and 4 show a number of conventional versions of the system used to attach the stem of the television tube to the vacuum line of the cart;

FIG. 5 outlines the principle of the invention;

FIG. 6 shows a further development of FIG. 5;

FIGS. 7, 8 and 9 show three possible variants of a further development of the invention;

DETAILED DESCRIPTION OF FIGS. 1–4

Figure 10:
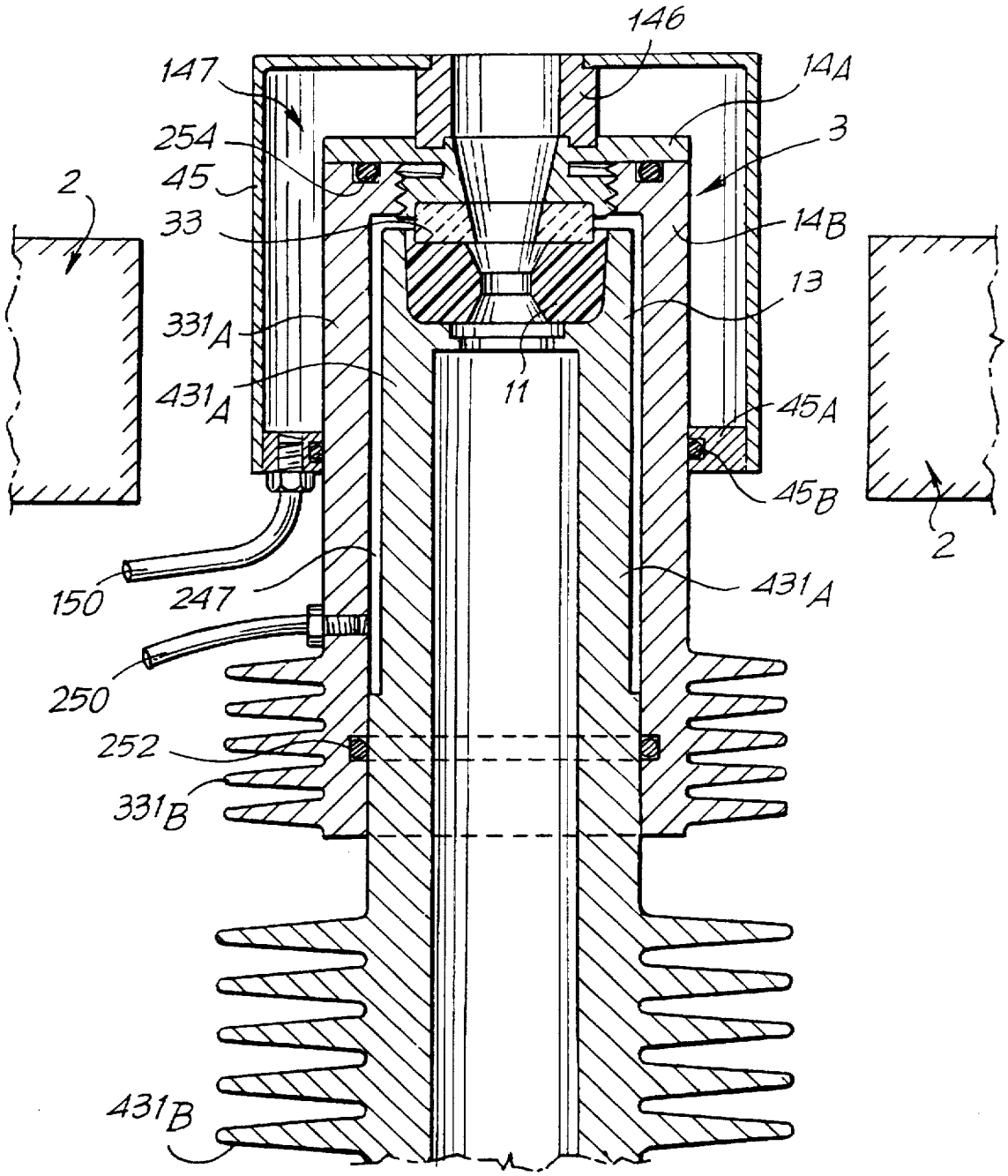
FIG. 10 shows yet another possible embodiment of the invention.

FIG. 1 shows a practical example of the conventional exhaust cart C. At the top of the cart a special mount supports the television tube 1, which can thus pass along inside the oven 2; a device 3 known as a gripper connects the television tube 1 to the vacuum line 6 via the neck 1A and the tubular stem 1B of this television tube 1. FIGS. 2, 3 and 4 schematically show the gripper in three different conventional constructional forms, with which it is possible to cool the gripper. As can be seen, vacuum leaktightness is provided by an O ring seal 11, normally in silicone rubber or other such materials, which surrounds the terminal tubular stem 1B of the television tube. When the ring seal 11 is compressed by some suitable system, it tightens around the stem 1B and seals off the vacuum. Normally the inside of the gripper 3 forms a seat 13 that acts as a housing for the O ring seal 11. A gland 14 exerts the compressive force on the ring seal 11. Sometimes, to make it simple to change the O ring seal 11, the gland 14 is divided into two parts fastened together by means of a screw thread; see FIG. 10. The number 16 indicates the environments in which the vacuum is created, while 18 indicates the cavities through which the cooling water is circulated.

The bottom part of the cart C contains all the components of the vacuum line, the components of the water cooling circuit and other supplementary and service components. The vacuum pumping system comprises two pumps in series, a high-vacuum pump 20 and a roughing pump 22. The vacuum pumps are connected to the television tube 1 via the vacuum line 6 and the cavity 16 of the gripper 3.

An important part of the cart, in terms of both the running costs and the frequent maintenance required, is the cooling circuit. A cart needs a supply of chilled water to cool three components: the radio-frequency coil, if present, the high-vacuum pump 20 and the gripper 3. The necessary water is taken up through a loading tube 27 projecting out of the cart, with its end in one of two adjacent channels 28 which are fixed to the floor and run the full length of the towing system parallel to the direction of movement of the carts. A second tube 29 returns the water to the other channel 28. A pump 30 on board the cart, with its intake connected to the loading tube 27, circulates the water through all of the components that must be cooled. A centralized plant for chilling and distributing the water keeps the channel full at all times so that the cart always has sufficient water at a relatively cold temperature. One of the problems experienced with the channel 28 is that because it is open, it easily collects not only fragments of glass produced by accidental breakages, that is implosions, of television tubes, but also dust from the surrounding environment, which in the long run leads to the development of mildew and algae. This dirt is sucked into the water pump and makes frequent maintenance necessary, both of the pump and of the other component parts of the cooling circuit. The presence of toxic substances such as the so-called phosphors (which in actual fact are rare earths) in the glass of the television tube makes maintenance potentially hazardous to the health of the workers in question, and this makes it necessary to adopt a range of precautions which complicate the operation and make it expensive. The chilled water is also a source of inefficiencies of production, because every time the supply runs out a reject television tube is produced. These facts, and the substantial costs of installing and running the central water chilling and distributing plant mean that the problem of how to eliminate the cooling circuit from the cart is taken very seriously. That it has not so far been possible is due solely to the fact that no alternative to the water method has been found for cooling the gripper; for although the high-vacuum pump and the radio-frequency coil can conveniently be air-cooled, at present there are no workable methods—other than water—for cooling the gripper. However, if the gripper 3 is not cooled the mechanical characteristics of the O ring seal 11 are rapidly degraded and it loses its ability to seal off the vacuum because, as tests have shown, the temperature of the ring seal reaches very high values in the absence of cooling water.

DESCRIPTION OF THE PREFERRED EMBODIMENTS

The problem is therefore how to devise an efficient, reliable cooling method which does not employ water, and which carries away the heat of the interior of the oven that attacks the gripper. The system must also guarantee cooling even under the most unfavorable conditions, which are those of a cart standing in the station of maximum temperature when the towing system is halted for an indefinite period because of a breakdown.

The invention solves the problem of how to eliminate water-cooling of the gripper with a different cooling system whose efficiency is sufficient to ensure the protection of the ring seal. Auxiliary arrangements can be added to this cooling system in order to keep the flow of heat to the gripper 3 as low as possible.

The cart according to the invention is identical to a normal exhaust cart except for the complete absence of any on-board watercooling circuit.

This is achieved by a special design of the gripper whereby most of the thermal flux passes to parts having lower thermal resistance, away from the O ring seal.

The principal means of removing heat from the gripper and carrying the heat out of the oven is a block of material—generally metal—having good thermal conductivity, which sucks heat out of the gripper.

For the sake of simplicity, FIG. 5 shows the heat-conducting block applied to the type of gripper shown in FIG. 3. In FIG. 5 a block 31 replaces the component forming the cavity 18 used in FIG. 3 for circulation of the cooling water. The block 31 and the gland 14 are connected so as to make a good thermal contact; the gland can also be made of the same heat-conducting material and can even be one piece with the block. The block 31 is long enough that its lower end is outside the oven 2; in this way the heat that strikes the gripper assembly, and in particular the gland, is carried away by conduction of heat into the block 31 and out of the oven 2 where it can easily be dissipated in a variety of ways, such as natural or forced convection, using a finned portion 31A that disperses heat spontaneously or gives it up to a stream of blown air. The arrangement illustrated in FIG. 5 is not restrictive, and it is just as easily possible for the conducting block to be applied to the seat 13, as shown at 131 in FIG. 7, as to the gland 14, as has been described with reference to FIG. 5 and as is indicated at 231 in FIG. 9, or to both (gland 14 and seat 13) as indicated at 331 and 431 in FIG. 8.

For reliable operation of the means described above—in view of the slightly poorer thermal conducting capacity of the blocks 31 or 131 or 231 or 331, 431 compared with the capacity offered by the circulating-water system—it is advantageous that the flow of heat toward the gripper not exceed certain values, and it is also useful to adopt suitable arrangements for obstructing the transmission of heat toward the ring seal 11.

FIG. 6 shows a partial view of the gland 14 and of the seat 13 for the ring seal 11. In the region of contact between the O ring seal 11 and the gland 14, a suitable component 33 made of a material of low thermal conductivity is interposed. This component 33 performs the function of a thermal break by virtue of its low conductivity, and consequently causes the heat to tend to flow toward regions in which it encounters lower thermal resistance, that is, toward the block 31. The O ring seal 11 therefore receives less heat and its temperature consequently rises less. The component 33, of great thickness, may be made of ceramic, glass, asbestos cement or the like.

In order to reduce the flow of heat that reaches the gripper 3, an auxiliary means may be used in combination with the conduction system via the block 31 or 131 or 231 or 331 and 431. This auxiliary means involves the use of a protective shield around the gripper.

In the conventional configuration, the gripper exchanges heat with the oven essentially by convection and radiation, and circulating water (or other liquid) is used to carry the heat away by convection through the movement of a liquid, which implies a circuit, a pump and other accessories, which can break down and so bring about obvious and serious damage.

The invention uses a system of heat dissipation by conducting the heat through the block 31 or 131 or 231 or 331 or 431 or other equivalent component. As an accessory to this (FIGS. 7 through 9), a shield 45 is also advantageously used. This is supported by the gripper 3 and in particular by the gland 14, through supports 46 acting also as distance pieces relative to the gripper. The shield 45 is concentric with the gripper 3 and external to it; said shield receives heat from the oven and is capable of reflecting part of it, and in turn exchanges part of the heat with the gripper. In general, the shield is connected to the gland 14, which surrounds the seat of the O ring seal 11. The exchange of heat between the shield and the gripper takes place by radiation alone if a vacuum is formed in the space 47 between the two components, or else by radiation and conduction (and also convection) if air is present in said space 47 between the two components. The shield thus protects the gripper from direct heat. Both of these methods of exchange can be reduced by appropriate design and construction.

In order to reduce exchange by radiation, both the inner and outer surfaces of the shield 45 and the outer surface of the components of the gripper 3 may have a low emissivity value; this may be ensured equally well by suitably polishing the surfaces in question or by adding some reflective material. Purely by way of example, aluminum may be cited as a polishable material and nickel-plating as a treatment of material addition. In order to reduce the exchange of heat through the layer of air in the space 47 between the shield 45 and the gland 14, the two components must be correctly dimensioned so that the layer of air is sufficiently thick, it being known that air is an excellent heat insulator. One such arrangement is illustrated in FIG. 10, where the space 147 (the equivalent to the space 47) is larger than the space 47, it being possible for the shield 45 to be supported by a single distance support 146. An even better result can be obtained by evacuating this space, it being known that heat conduction through air is a function of pressure; more precisely, thermal conductivity is constant from atmospheric pressure down to about 100 mbar. Below this pressure, conductivity decreases linearly with pressure until, at 10-3 mbar, it is from 10000 to 1000 times lower than conductivity at atmospheric pressure; this means there is practically no heat exchange by conduction. It should be stressed that the two vacuum pumps such as 20 and 22, which are still present on the cart, are well able to take the pressure down to as low as 10-6 mbar.

FIG. 10 shows arrangements using evacuation as a means of thermally insulating the gripper 3. In this form, the seat 13 for the O ring seal 11 is provided with a heat-conducting block 431A similar to the block 431 of FIG. 8. The gland 14 consists of two parts 14A and 14B screwed together, which makes replacing the ring seal 11 easier; likewise the gland 14A, 14B is provided with a heat-conducting block 331A similar to the block 331 of FIG. 8. The space 147 may be open to the atmosphere or at least partially evacuated, while the base of the shield 45 is provided with a ring 45A which, with a suitable ring seal 45B (acting on the block 331A), provides leaktightness vis-a-vis the exterior. A pipe 150 connects the space to a vacuum source, for example the pump 22 or the pump 20, so that the space 147 can be evacuated, for the reasons indicated.

A space 247 may be provided, for the same reason as above, between the seat 13 and the gland 14 (or 14A, 14B), between the blocks such as 331A, 431A of FIG. 10. A similar space 347 may be provided between the block 31 and the seat 13 of FIG. 5 or between the block 231 and the seat 13 of FIG. 9. This space 247 or 347 may be at ambient pressure and open to the atmosphere or may be evacuated. Said spaces 247 or 347 may replace the space 47 or 147 or may be combined with the latter. FIG. 10 illustrates a pipe 250 connecting the space 247 to a vacuum source, such as the pump 22 (or 20), in which case suitable ring seals such as 252 and 254 keep the vacuum formed in the chamber 247 leaktight.

For the extraction of heat from the heat-conducting blocks such as 331 and 431 (FIG. 8) and such as 331A and 431A (FIG. 10), fins 331B and 431B may be provided at the ends of the two blocks underneath each other, as shown in FIG. 10; the two sets of fins 331B and 431B can be swept by a stream of air blown with greater or lesser velocity, which will extract heat from the blocks. The fins may also be present on only one of the two components, where heat removal is sufficient to maintain the temperature of the O ring seal 11 at an acceptable value.

We claim:

1. A television tube plant, comprising an oven tunnel, and a plurality of exhaust carts moving around in a closed circuit, each cart including:

an O-ring seal;

a gripper for gripping a stem of a television tube which is moved by said cart inside said oven tunnel, said gripper including a seat and a gland for said O-ring seal;

vacuum forming means for forming the vacuum in the television tube, said O-ring seal, said seat and said gland cooperating to provide leaktightness around a stem of the television tube connected to said vacuum means; and a cooling system to protect said ring seal from heat associated with said oven, said system comprising a cold source and a block that conducts heat well, said block being in contact with at least one of said seat and said gland of said gripper for transferring heat of said gripper to said cold source.

2. The television tube plant as claimed in claim 1, wherein said block is in contact with said seat at a contact location and extends from said contact location with said seat.

3. The television tube plant as claimed in claim 1, wherein said block is in contact with said gland at a contact location and extends from said contact location with said gland.

4. A television tube exhaust cart, comprising:

an O-ring seal;

a gripper for gripping a stem of a television tube, said gripper including a seat and a gland for said O-ring seal;

vacuum forming means for forming the vacuum in the television tube, said O-ring seal, said seat and said gland cooperating to provide leaktightness around a stem of the television tube connected to said vacuum means; and a cooling system to protect said ring seal from heat associated with television tube formation, said system comprising a cold source and a block that conducts heat well, said block being in contact with at least one of said seat and said gland of said gripper for transferring heat of said gripper to said cold source.

5. The exhaust cart as claimed in claim 4, wherein said block extends downward coaxially with the gripper and is of tubular shape.

6. The exhaust cart as claimed in claim 4, wherein said block is in contact with said seat at a contact location and extends from said contact location with said seat.

7. The exhaust cart as claimed in claim 4, wherein said cooling system comprises said block and another block, said block and said another block being provided as two coaxial blocks, with one of said coaxial blocks extending from said seat and one of said coaxial blocks extending from said gland.

8. The exhaust cart as claimed in claim 4, wherein said cooling system further includes a fins provided as part of said block, said fins being disposed below and at a distance from the gripper for the dissipation of heat to said cold source.

9. The exhaust cart as claimed in claim 4, wherein said cold source is blown surrounding air.

10. The exhaust cart as claimed in claim 4, comprising thermal barrier means including a component made of a material of low thermal conductivity, said thermal barrier means being interposed between said O-ring seal and said gland to limit the flow of heat toward said O-ring seal.

11. The exhaust cart as claimed in claim 4, wherein said cooling system comprises said block and another block, said block and said another block being provided as two coaxial blocks, with one of said coaxial blocks extending from said seat and one of said coaxial blocks extending from said gland, said two coaxial blocks forming a space defining a thermal break.

12. The exhaust cart as claimed in claim 4, further comprising a shield surrounding the gripper and defining with it a space forming a thermal break, said shield being connected with said gripper by supports made of a material with a low coefficient of heat transmission.

13. The exhaust cart as claimed in claim 12, wherein said space is at least partially evacuated by connecting said space to said vacuum forming means.

14. The exhaust cart as claimed in claim 4, wherein said block is in contact with said gland at a contact location and extends from said contact location with said gland.

15. The exhaust cart as claimed in claim 14, wherein said block and seat form a space defining a thermal break.

16. The exhaust cart as claimed in claim 14, wherein said cooling system further includes a fins provided as part of said block, said fins being disposed below and at a distance from the gripper for the dissipation of heat to said cold source.

17. The exhaust cart as claimed in claim 14, wherein said cold source is blown surrounding air.

18. The exhaust cart as claimed in claim 14, comprising thermal barrier means including a component made of a material of low thermal conductivity, said thermal barrier means being interposed between said O-ring seal and said gland to limit the flow of heat toward said O-ring seal.

19. The exhaust cart as claimed in claim 14, further comprising a shield surrounding the gripper and defining with it a space forming a thermal break, said shield being connected with said gripper by supports made of a material with a low coefficient of heat transmission.

20. The exhaust cart as claimed in claim 19, wherein said space is at least partially evacuated by connecting said space to said vacuum forming means.

* * * * *